US009421989B2

(12) United States Patent
Oohashi et al.

(10) Patent No.: US 9,421,989 B2
(45) Date of Patent: Aug. 23, 2016

(54) ROLLING STOCK

(75) Inventors: Kengo Oohashi, Nagoya (JP); Kentaro Hayashi, Nagoya (JP)

(73) Assignee: Nippon Sharyo, Ltd., Nagoya-shi (JP)

( * ) Notice: Subject to any disclaimer, the term of this patent is extended or adjusted under 35 U.S.C. 154(b) by 23 days.

(21) Appl. No.: 14/374,560

(22) PCT Filed: Jan. 27, 2012

(86) PCT No.: PCT/JP2012/051764

§ 371 (c)(1),
(2), (4) Date: Oct. 1, 2014

(87) PCT Pub. No.: WO2013/111315

PCT Pub. Date: Aug. 1, 2013

(65) Prior Publication Data

US 2015/0033978 A1 Feb. 5, 2015

(51) Int. Cl.

| | |
|---|---|
| ***B61F 19/00*** | (2006.01) |
| ***B61F 19/04*** | (2006.01) |
| ***B61D 15/06*** | (2006.01) |
| ***B61F 1/10*** | (2006.01) |
| ***B61D 17/06*** | (2006.01) |
| ***B61D 17/02*** | (2006.01) |

(52) U.S. Cl.

CPC ..... *B61F 19/04* (2013.01); *B61D 15/06* (2013.01); *B61D 17/02* (2013.01); *B61D 17/06* (2013.01); *B61F 1/10* (2013.01)

(58) Field of Classification Search

CPC ..... B61D 17/02; B61D 17/04; B61D 17/06; B61D 17/08; B61D 15/06; B61F 1/02; B61F 1/10

See application file for complete search history.

(56) References Cited

U.S. PATENT DOCUMENTS

| | | | | |
|---|---|---|---|---|
| 6,167,815 | B1 | 1/2001 | Werner et al. | |
| 2002/0073887 | A1 | 6/2002 | Godin et al. | |
| 2003/0056683 | A1 | 3/2003 | Yamaguchi et al. | |
| 2007/0261591 | A1 | 11/2007 | Bravo et al. | |
| 2009/0283009 | A1 | 11/2009 | Bravo et al. | |
| 2010/0126813 | A1 | 5/2010 | Hayashi | |
| 2012/0325108 | A1 * | 12/2012 | Graf | B61F 1/10 105/392.5 |

FOREIGN PATENT DOCUMENTS

| | | | |
|---|---|---|---|
| EP | 0329551 | A1 | 8/1989 |
| EP | 0612647 | A1 | 8/1994 |
| EP | 0802100 | A1 | 10/1997 |

(Continued)

OTHER PUBLICATIONS

International Search Report dated Apr. 17, 2012, issued for PCT/JP2012/051764.

*Primary Examiner* — Jason C Smith
(74) *Attorney, Agent, or Firm* — Locke Lord LLP

(57) ABSTRACT

A rolling stock includes: a pair of left and right post members provided upright on inner sides of left and right end portions of an end beam of an underframe, the end beam joined to a lower portion of a cab end structure; a recess portion open frontward, the recess portion formed in a front portion of the end beam between the pair of post members; and an impact absorbing member disposed between a bottom face of the recess portion and an inner face of the outside plate. The recess portion has such a size that the impact absorbing member is accommodated within the recess portion after being compressively deformed. Since the impact absorbing member is disposed on an inner side of the outside plate, the impact absorbing member is not exposed to the outside of the car body, and thus does not impair the design of the car body.

4 Claims, 6 Drawing Sheets

(56) References Cited

FOREIGN PATENT DOCUMENTS

| | | | |
|---|---|---|---|
| JP | 2000-506473 | A | 5/2000 |
| JP | 2001-026268 | A | 1/2001 |
| JP | 2001-048016 | A | 2/2001 |
| JP | 2002-225704 | A | 8/2002 |
| JP | 2003-095097 | A | 4/2003 |
| JP | 2010-125858 | A | 6/2010 |
| JP | 2011-235730 | A | 11/2011 |
| JP | 2011-235733 | A | 11/2011 |

* cited by examiner

ROLLING STOCK

TECHNICAL FIELD

The present invention relates to a rolling stock, and relates specifically to an impact absorbing structure in a rolling stock having a streamlined head shape.

BACKGROUND ART

A car body of a rolling stock is formed by joining side structures and end structures to four side portions of an underframe, then joining a roof structure to upper portions of the side structures and the end structures, and attaching outside plates, floor plates, interior decorative members, doors, windows, and the like to the structures. In the conventional rolling stock, a passenger compartment is protected by reinforcing the end structures and the underframe portions or by providing impact absorbing members, as collision countermeasures (see for example Patent Document 1). In addition, a rolling stock having a vestibule generally employs a structure in which the vestibule portion is configured as a breakable region (a crushable zone or an impact absorbing part) (see for example Patent Document 2).

PRIOR ART DOCUMENTS

Patent Documents

Patent Document 1: Japanese Patent Application Publication No. 2001-48016

Patent Document 2: Japanese Patent Application Publication No. 2001-26268

SUMMARY OF THE INVENTION

Problem to be Solved by the Invention

In the case of a general flat-shaped end structure, the strength of the end structure is also improved by thickening the posts or by providing reinforcement members. However, in the case of a cab end structure of a rolling stock in which one of the end structures is formed in a streamlined shape, since the cab end structure is provided with a driver's cabin, it is impossible to thicken the posts or to provide reinforcement members. Moreover, in the case where there is no vestibule because a passenger compartment continues from the rear of the driver's cabin, it is difficult to provide a crushable zone including an impact absorbing member.

Accordingly, an object of the present invention is to provide a rolling stock including an impact absorbing structure capable of protecting a driver's cabin and a passenger compartment even when a large external force is applied to a cab end structure formed in a streamlined shape.

Means for Solving the Problem

To achieve the above-described object, a rolling stock of the present invention is a rolling stock in which a cab end structure, an end structure, an underframe, side structures, and a roof structure are joined together, and the cab end structure is covered with an outside plate having a streamlined shape, the rolling stock including: a pair of left and right post members provided upright on inner sides of left and right end portions of an end beam of the underframe, the end beam being joined to a lower portion of the cab end structure; a recess portion being open frontward, the recess portion being formed in a front portion of the end beam between the pair of post members; and an impact absorbing member disposed between a bottom face of the recess portion and an inner face of the outside plate.

Moreover, in the rolling stock of the present invention, the recess portion has such a size that the impact absorbing member is accommodated within the recess portion after being compressively deformed, lower reinforcement members are provided between opposite side faces of a front end portion, on the end beam side, in a center beam of the underframe and lower end portions of the corresponding post members, respectively, and an upper reinforcement member is provided on an upper face of the front end portion, on the end beam side, in the center beam of the under frame, the upper reinforcement member having a trapezoidal shape having a rear end portion corresponding to width dimension of the center beam and a front end portion expanding toward both of the post members.

Effect of the Invention

According to the rolling stock of the present invention, an external force applied to the front face of the car body can be absorbed by the impact absorbing member provided between the recess portion, which is formed in the front portion of the end beam, and the inner face of the outside plate. Accordingly, it is possible to suppress direct application of the external force to the end beam and to thus protect the driver's cabin and the passenger compartment located rearward of the end beam. In addition, since the impact absorbing member is disposed on the inner side of the outside plate, the impact absorbing member is not exposed to the outside of the car body, and thus does not impair the design of the car body. Moreover, since the impact absorbing member compressively deformed by the external force is accommodated within the recess portion, the external force does not concentrate on part of the end beam. Accordingly, the external force after the impact absorbing member is compressively deformed can be received by the entire end beam. Furthermore, providing the lower reinforcement member and the upper reinforcement member makes it possible to surely cause the impact absorbing member to be compressively deformed by suppressing deformation of the end beam.

MODES FOR CARRYING OUT THE INVENTION

Figure 1:
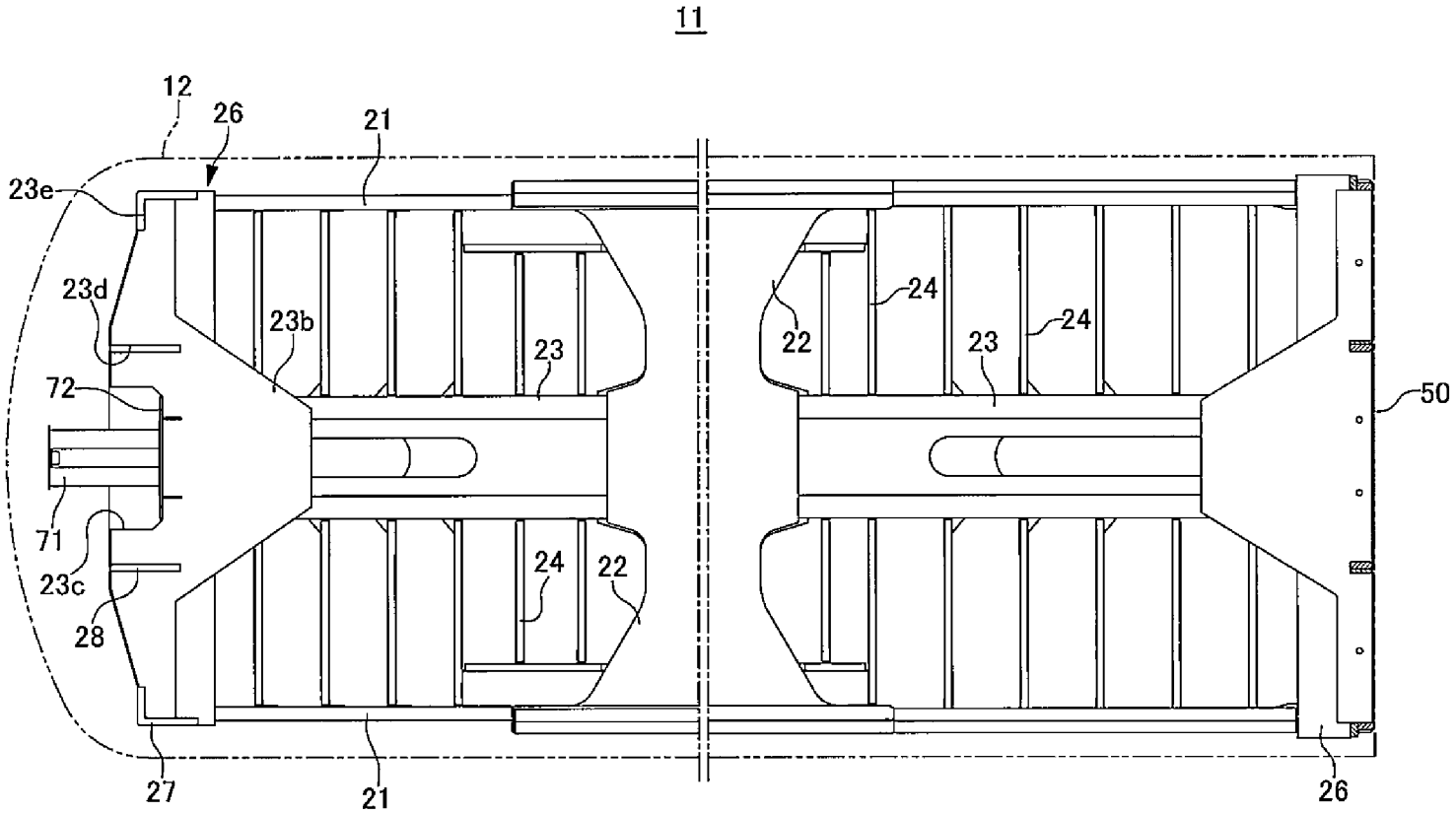
FIG. 1 is a plan view of an underframe showing one embodiment of a rolling stock of the present invention.
Figure 2:
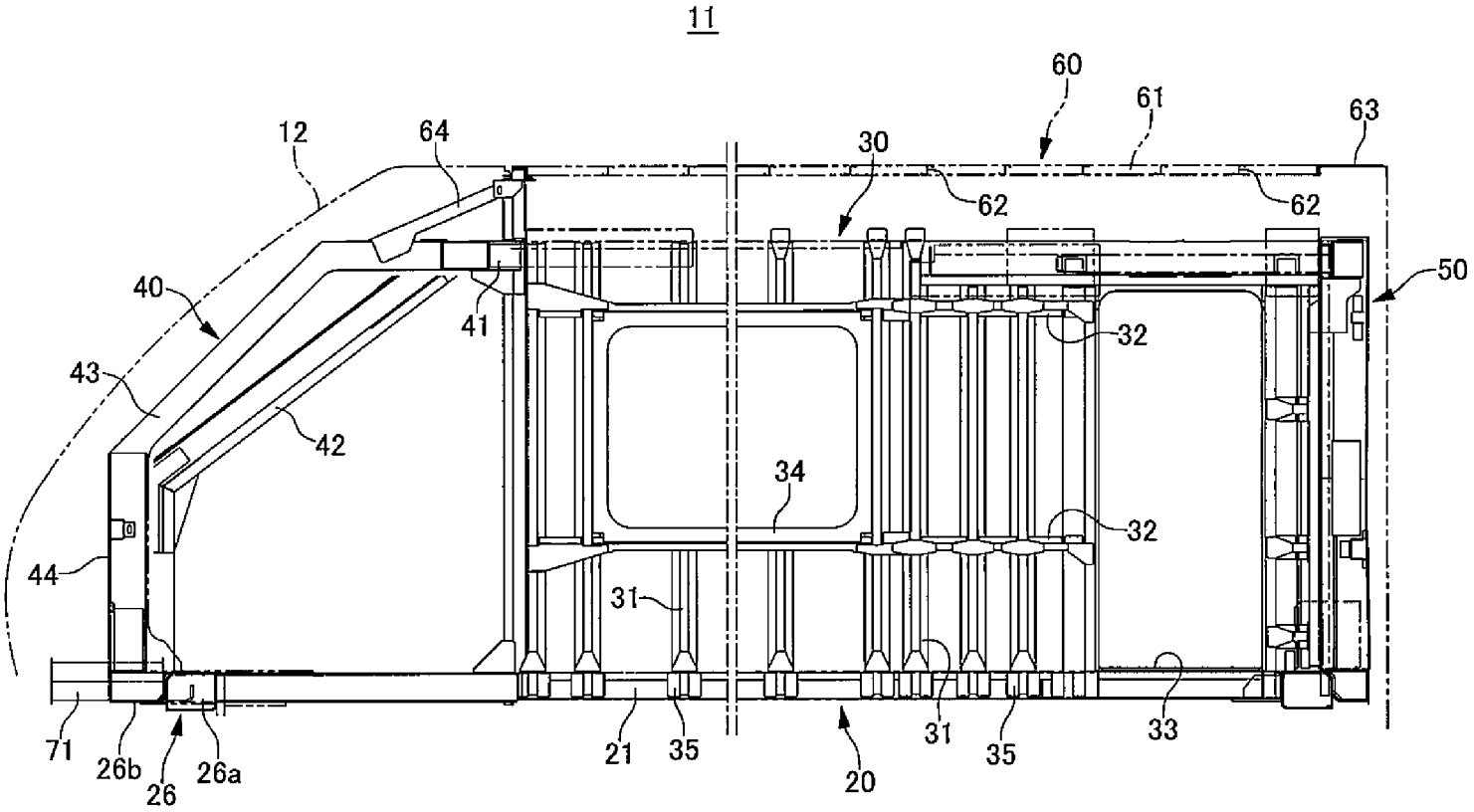
FIG. 2 is a side view of a rolling stock structure showing the same.

A rolling stock shown in the embodiment is a first rolling stock 10 having a streamlined shape in a front end of a car body. A rolling stock structure 11 forming the first rolling stock 10 includes: an underframe 20; a pair of left and right side structures 30 provided on the opposite sides of the underframe 20; a cab end structure 40 and an end structure 50 provided respectively on the opposite ends of the underframe 20 and the side structures 30; and a roof structure 60 provided to cover upper portions of the side structures 30, the cab end structure 40, and the end structure 50. The cab end structure 40 is formed in a streamlined shape in which an upper half portion is inclined rearward and the opposite side portions are inclined rearward.

The underframe 20 includes: a pair of left and right side beams 21 disposed in a rail direction (a front-rear direction of the car body); a pair of front and rear bolster beams 22 disposed in a railroad-tie direction (a width direction of the car body) near the front and rear end portions; center beams 23 provided in a center portion of the underframe 20 in parallel with the side beams 21; a plurality of cross beams 24 coupling the side beams 21 and the center beams 23 in the railroad-tie direction; end beams 26 provided respectively on leading ends of the center beams 23 on the car-body opposite end sides of the bolster beams 22. An impact absorbing member attachment recess portion 72, which is open frontward for attaching an impact absorbing member 71, is formed in a front portion of the end beam 26 disposed on the cab end structure 40 side.

The side structures 30 include: a plurality of side posts 31 extending in a vertical direction; a plurality of frame members 32 extending in the front-rear direction of the car body; door frame parts 33 forming gate opening portions; and window frame parts 34 forming side-window opening portions. Lower end portions of the side posts 31 are joined to outer faces of the corresponding side beams 21 on lower portion protruding pieces 21*a* protruding sideward from lower ends of the side beams 21 by means of joint members 35.

The cab end structure 40 has a driver's cabin provided in a center portion in the width direction of the car body. An upper reinforcement beam 41 extending in the railroad-tie direction is provided at a joint portion between an upper end portion of a rear side of the cab end structure 40 and upper end portions of head sides of the side structures 30. A pair of left and right corner posts 42 are provided in a front end portion of the cab end structure 40 in such a manner as to extend between the opposite end portions of the end beam 26 in the width direction and the opposite end portions of the upper reinforcement beam 41 in the width direction. A pair of left and right end posts 43 are provided at positions on the opposite sides of the driver's cabin, and on the inner sides of the corner posts 42, in such a manner as to extend between the end beam 26 and the upper reinforcement beam 41. On the other hand, the end structure 50 on the rear coupling side is formed in a flat-plate shape, and has a through-hole opening portion provided in a center portion in the width direction.

The roof structure 60 is formed of: long girders 61 disposed in the rail direction; a plurality of rafters 62 extending in the railroad-tie direction, which are joined orthogonally to the long girders 61; and a roof board 63 joined to outer face sides of the rafters 62. The long girders 61 are joined to upper end portions of the side structures 30, and the rafters 62 on the front and rear ends are joined respectively to an upper end portion of the cab end structure 40 and an upper end portion of the end structure 50. In addition, a front end of the roof structure 60 and upper portions of the end posts 43 are coupled by coupling members 64.

Figure 3:
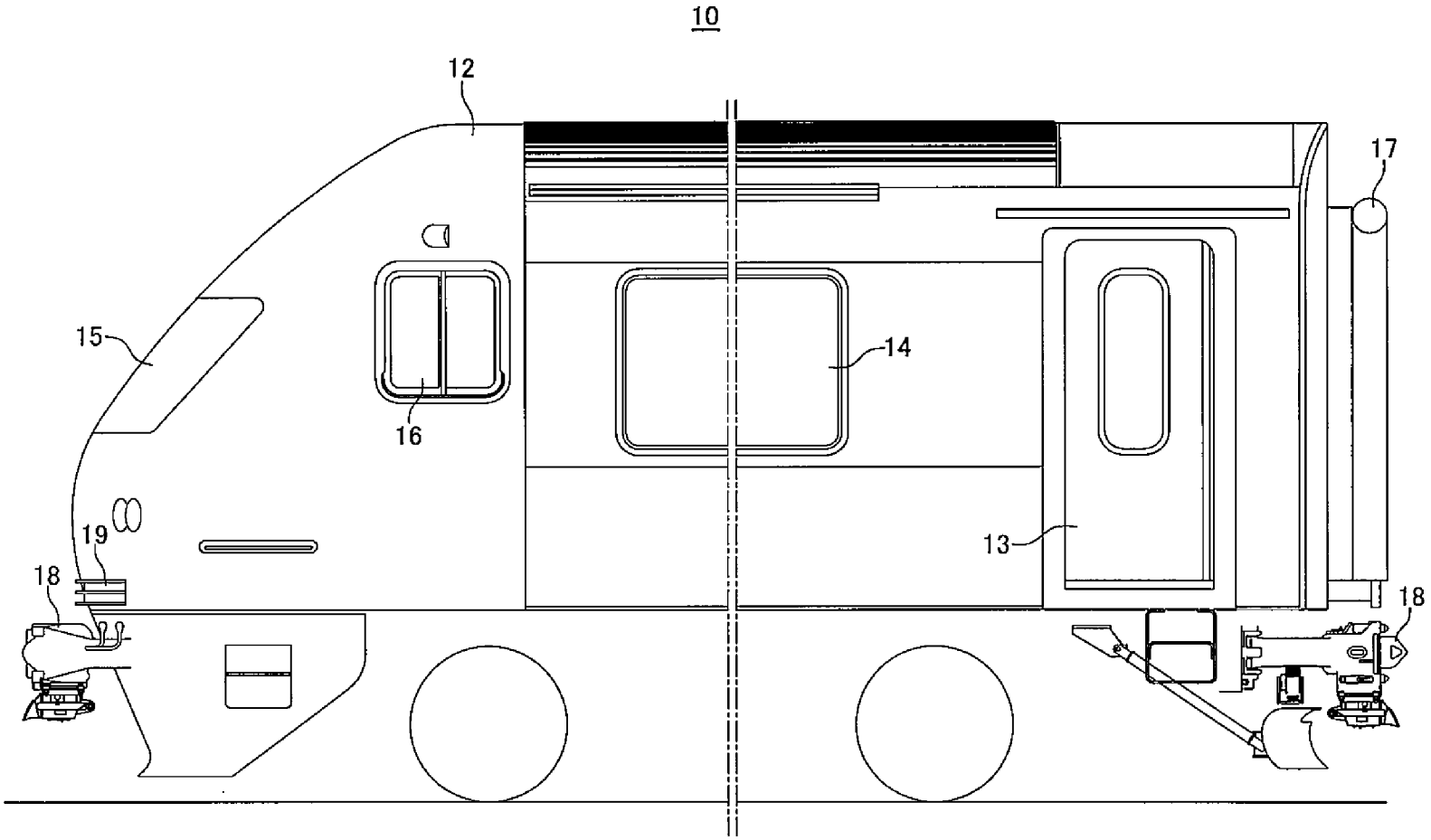
FIG. 3 is a side view showing an appearance of the rolling stock.
Figure 4:
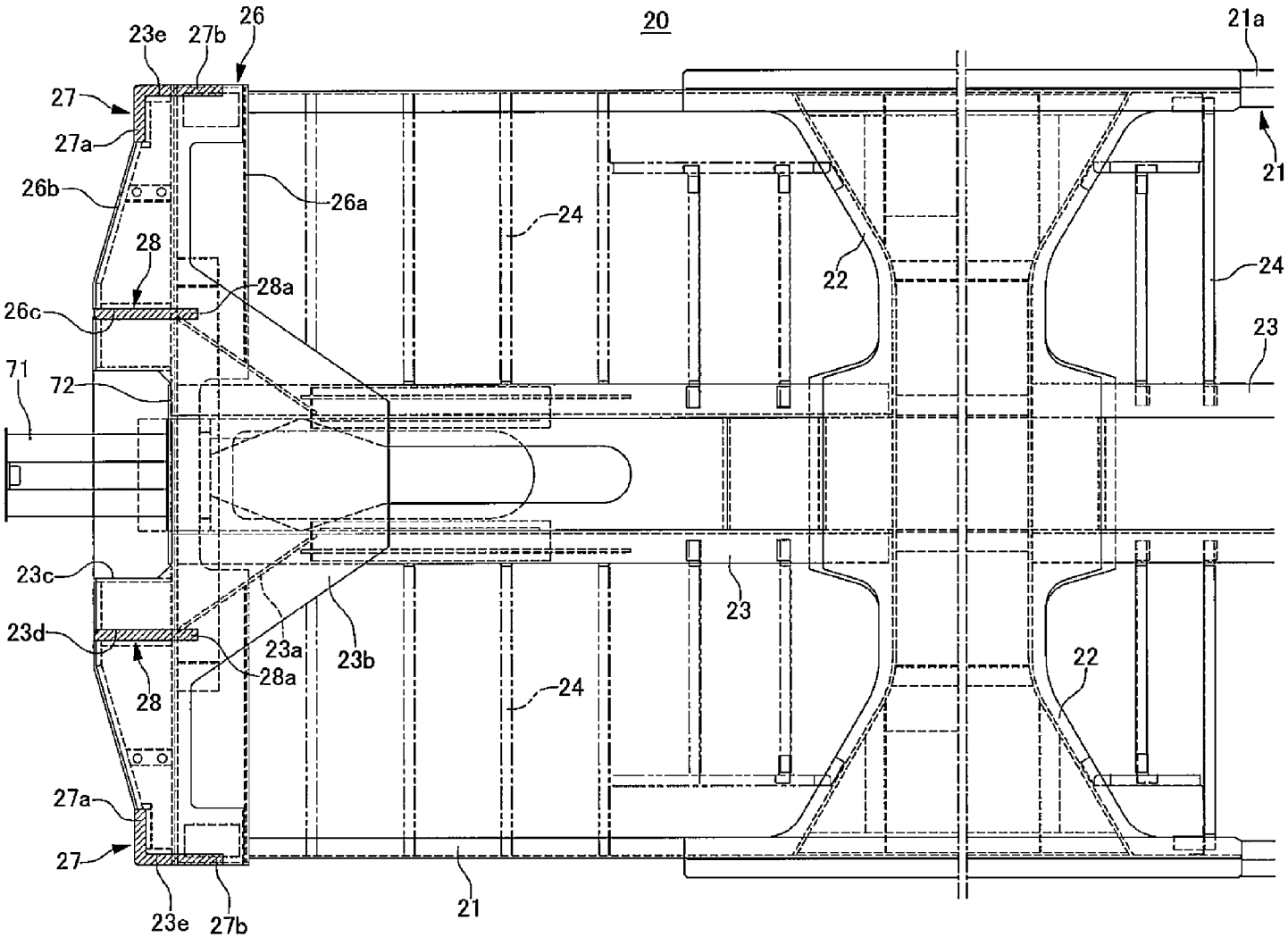
FIG. 4 is a plan view showing a main part of the underframe.
Figure 5:
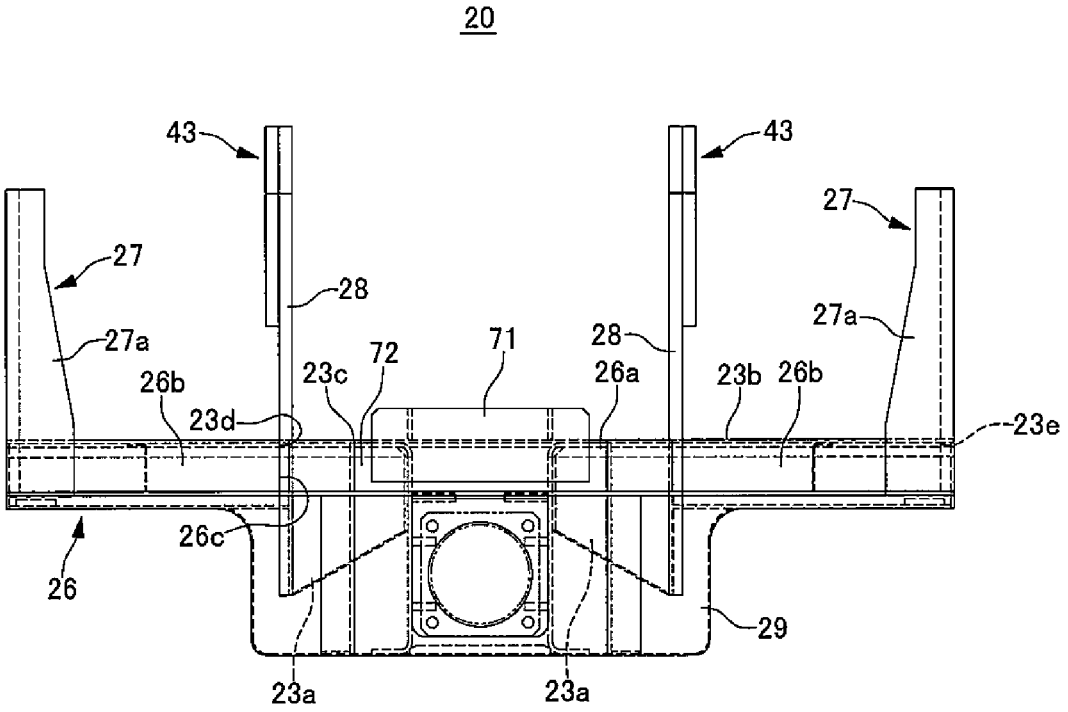
FIG. 5 is a front view of the underframe.
Figure 6:
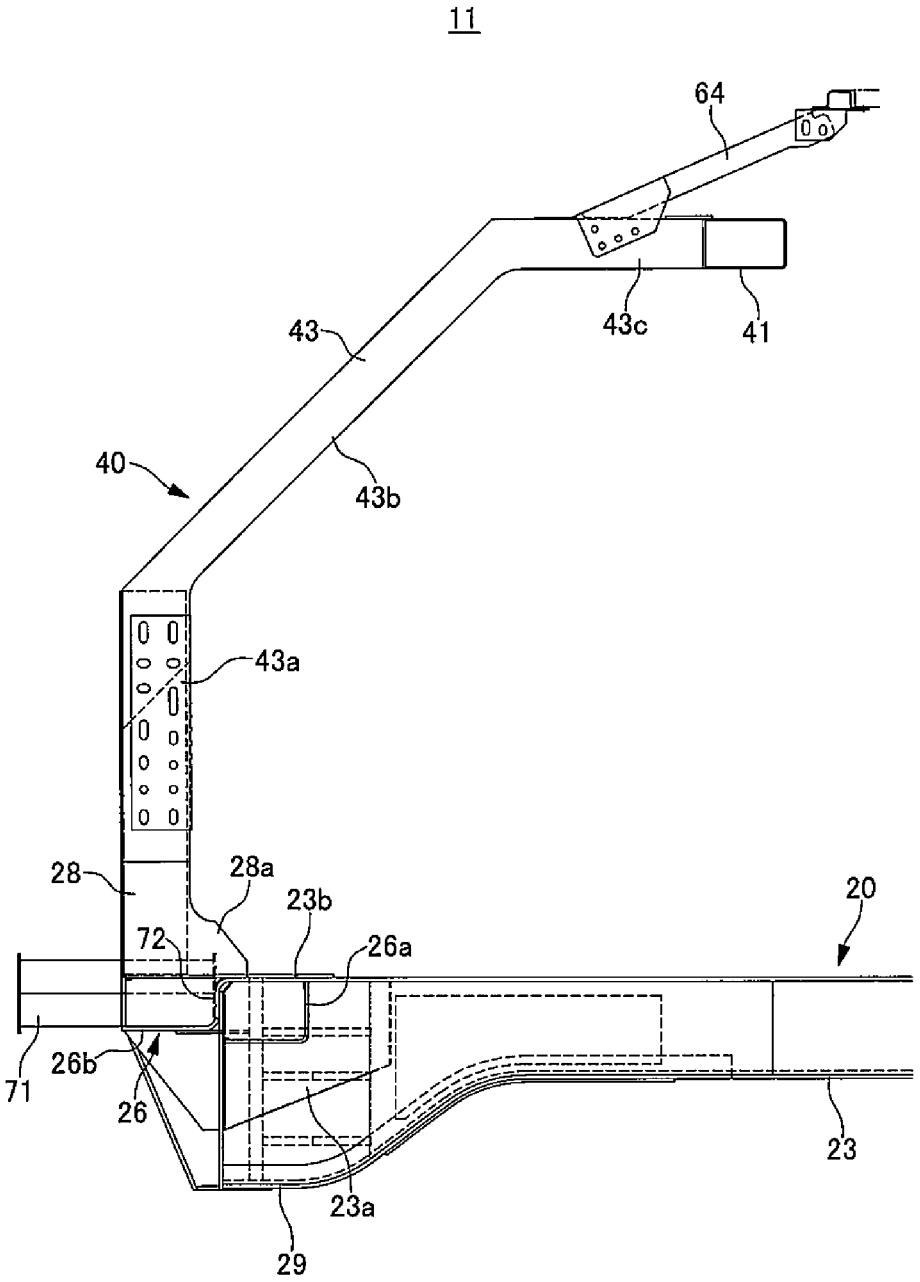
FIG. 6 is a cross-sectional side view showing a joint portion between the underframe and a cab end structure.

As shown in FIG. 3, outside plates 12 having shapes corresponding to the corresponding structures are attached to outer sides of the structures, and rigs and interior decorations, including various instruments and seats, are provided inside and outside the structures. In addition, a passenger door 13 is provided in the door frame part 33 and a side window 14 is provided in the window frame part 34. A front window 15 is provided in a middle portion of the front face of the cab end structure 40 in the up-down direction, and a crew window 16 is provided in a side face of the cab end structure 40. A coupling hood 17 is provided around the through-hole opening portion of the end structure 50. Moreover, couplers 18 are provided respectively on lower portions of the opposite ends of the car body, and an anti-climber 19 is provided in a lower portion of the front face. By mounting required components such as the outside plate 12 inside and outside the rolling stock structure 11 as described above, the streamlined first rolling stock 10 with a rounded head portion having the driver's cabin at the center in the width direction is formed.

The end beam 26 provided in an end portion (front end portion) of the underframe 20 on the cab end structure side includes: a main end beam 26*a*, which is continuous in the railroad-tie direction and corresponds to the width of the car body; and reinforcement end beams 26*b*, 26*b* provided on the opposite side portions of a front face of the main end beam 26*a* in such a manner as to form the impact absorbing member attachment recess portion 72. The impact absorbing member 71, which absorbs collision energy by being deformed by an external force at the time of collision, is attached to the impact absorbing member attachment recess portion 72 formed on the front face of the main end beam 26*a* between the reinforcement end beams 26*b*, 26*b* in a state where a front end portion of the impact absorbing member 71 is projected from the end beam 26.

As the impact absorbing member 71, any of various structures can be used as long as it has a sufficient impact absorbing ability, and for example, one disclosed in Japanese Patent Application Publication No. 2010-125858 can be used, which is obtained by combining a plurality of square pipes. The length of the impact absorbing member 71 in the front-rear direction may be such that the front protruding end of the impact absorbing member 71 stays behind the inner face of the outside plate 12 on the rear side, and the thickness of the impact absorbing member 71 may be set depending on the size of the impact absorbing member attachment recess portion 72. The length and thickness are thus set such that the length of the impact absorbing member 71 in the front-rear direction, which is compressively deformed at the time of collision, is accommodated within the impact absorbing member attachment recess portion 72.

In addition, a pair of left and right corner post reinforcement members 27 for reinforcing lower portions of the corner posts 42 provided in the cab end structure 40 and a pair of end reinforcement posts 28 joined to the lower portions of the end posts 43 are provided on the end beam 26. A coupler support frame 29 is provided on a center lower portion of the end beam 26. Each of the end reinforcement posts 28 has a rectangular cross-section long in the front-rear direction in order to withstand impact from the front. A lower portion of each end reinforcement post 28 is passed through a slit 26*c*, which is provided in the reinforcement end beams 26*b*, and is joined across the front face of the end beam 26 and the front face of the coupler support frame 29. Further, reinforcement projecting portions 28*a*, which are joined to an upper face of the end beam 26, are provided in rear portions of the end reinforcement posts 28. In addition, each of the corner post reinforcement members 27 is formed in an L-shaped cross-section. Reinforcement projecting portions 27*a* and 27*b*, which project toward the rear side of the car body and the inside of the car body and are joined to upper faces of side end portions of the main end beam 26*a* and upper faces of front end portions of the reinforcement end beams 26*b*, are provided respectively on lower portions of the corner post reinforcement members 27.

A pair of lower reinforcement plates 23*a* having plate faces directed in the vertical direction are provided between the opposite side faces of the front end portion, on the end beam 26 side, in the center beam 23 and the lower end portions of the corresponding end posts 43, respectively. Each of the lower reinforcement plates 23*a* has a rear end portion joined to the side face of the center beam 23 and has a front end portion joined to the rear side of the lower end portion of the end post 43. In a plan view, the lower reinforcement plates 23*a* are expanded from the joint portions with the center beam 23 to the joint portions with the end posts 43. In a side view, the lower reinforcement plates 23*a* have a trapezoidal shape in which both end joint portions are vertical, the upper edges are horizontal, and the lower edges are expand downward from the joint portions with the center beam 23 to the joint portions with the end posts 43.

Moreover, an upper reinforcement plate 23*b* is provided in a horizontal direction on an upper face of the front end portion, on the end beam 26 side, in the center beam 23. The upper reinforcement plate 23*b* has a trapezoidal shape having a rear end portion with a width dimension corresponding to the width dimension of the center beam and a front end portion expanding toward both of the end posts 43. The front end portion of the upper reinforcement plate 23*b* has a width dimension similar to the width dimension of the end beam 26, is provided with a center cut portion 23*c* corresponding to the impact absorbing member attachment recess portion 72 between the end posts 43, and is provided with slits 23*d* corresponding to the slits 26*c* provided in the reinforcement end beams 26*b*. Each of the opposite side end portions of the upper reinforcement plate 23*b* extends to the rear portion of the corresponding reinforcement projecting portions 27*a*, 27*b*, and is provided with an end cut portion 23*e* accommodating the reinforcement projecting portions 27*a*, 27*b*.

The end beam 26, which is provided with the impact absorbing member attachment recess portion 72, can be reinforced from the rear side by providing the lower reinforcement plates 23*a* and the upper reinforcement plate 23*b* as reinforcement member for the end beam 26. This makes it possible to prevent the end beams 26 from being deformed prior to the impact absorbing member 71, and to thus more securely cause the impact absorbing member 71 to be compressively deformed, upon receipt of an external force.

The end posts 43 are joined to the end reinforcement posts 28, and the corner posts 42 are joined to the corner post reinforcement members 27. Each of the end posts 43 is formed from a solid material made of steel, and includes: a lower post portion 43*a*, which extends in the vertical direction and is joined to the end reinforcement post 28; a window opening post portion 43*b*, which is located on an inner side of the front window 15; and an upper post portion 43*c*, which extends in the horizontal direction and has a rear end joined to the upper reinforcement beam 41.

Each of the lower post portions 43*a* has a rectangular cross-section long in the front-rear direction in the same manner as the end reinforcement posts 28 to withstand impact from the front like the end reinforcement posts 28. The lower post portion 43*a* is joined in a state of being placed over a side face of an upper half portion of the end reinforcement post 28, and is thus joined to the end beam 26 with the end reinforcement post 28 in between. Each of the window opening post portions 43*b* is provided to extend from an upper end of the lower post portion 43*a* while an upper portion of the window opening post portion 43*b* is inclined toward the rear of the car body in conformity with the inclination of the front window 15. The window opening post portion 43*b* is formed to have a smaller width dimension in the rail direction (the front-rear direction) than the width dimension of the lower post portion 43*a* in the rail direction, so as not to obstruct the driver's view. Each of the upper post portions 43*c* extends from the rear upper end portion of the window opening post portion 43*b* toward the upper reinforcement beam 41 in the horizontal direction.

The corner post 42 is joined in conformity with the corner post reinforcement member 27. The corner post 42 is also provided such that an upper portion of a portion thereof located on the inner side of the front window 15 is inclined toward the rear of the car body in conformity with the inclination of the front window 15.

In this way, in the rolling stock 10 having the streamlined shape provided with the driver's cabin in the center portion in the width direction of the car body, the impact absorbing member attachment recess portion 72, which is open frontward, is provided in the front portion of the end beam 26, and the impact absorbing member 71 is attached thereto. This makes it possible to bring the impact absorbing member 71 being compressively deformed by external force into a state of being accommodated in the impact absorbing member attachment recess portion 72. Accordingly, the external force, whose energy has been reduced after the compressive deformation of the impact absorbing member 71, is made capable of being received by the end beam 26 including the end posts 43, the end reinforcement posts 28, and the reinforcement end beams 26*b*. Therefore, the driver's cabin and the passenger compartment, which are locate rearward of the end beam 26, can be protected. In addition, since the impact absorbing member 71 having a longer length in the front-rear direction can also be accommodated on the inner side of the outside plate 12, the design unique to the streamlined shape is not impaired by the impact absorbing member 71. Furthermore, providing the lower reinforcement plates 23*a* and the upper reinforcement plate 23*b* makes it possible to more securely prevent the end beams 26 from being deformed, and to thus effectively conduct energy absorption by securely causing the impact absorbing member 71 to be compressively deformed.

Note that, the lower reinforcement member and the upper reinforcement member have not necessarily to be plate-shaped, and any material such as an angular material can be selected as appropriate. Moreover, the lower reinforcement member and the upper reinforcement member may be omitted depending on the shapes and structures of the center beam and the end beam.

EXPLANATION OF THE REFERENCE NUMERALS

10 first rolling stock
11 rolling stock structure
12 outside plate
13 passenger door
14 side window
15 front window
16 crew window
17 coupling hood
18 coupler
19 anti-climber
20 underframe
21 side beam
21*a* lower projecting piece
22 bolster beam
23 center beam
23*a* lower reinforcement plate
23*b* upper reinforcement plate
23*c* center cut portion

23*d* slit
23*e* end cut portion
24 cross beam
26 end beam
26*a* main end beam
26*b* reinforcement end beam
26*c* slit
27 corner post reinforcement member
27*a*, 27*b* reinforcement projecting portion
28 end reinforcement post
28*a* reinforcement projecting portion
29 coupler support frame
30 side structure
31 side post
32 frame member
33 door frame portion
34 window frame portion
35 joint member
40 cab end structure
41 upper reinforcement beam
42 corner post
43 end post
43*a* lower post portion
43*b* window opening post portion
43*c* upper post portion
50 end structure
60 roof structure
61 long girder
62 rafter
63 board
64 coupling member
71 impact absorbing member
72 impact absorbing member attachment recess portion

The invention claimed is:

1. A rolling stock in which a cab end structure, an end structure, an underframe, side structures, and a roof structure are joined together, and the cab end structure is covered with an outside plate having a streamlined shape, the rolling stock comprising:

a pair of left and right post members provided upright on inner sides of left and right end portions of an end beam of the underframe, the end beam being joined to a lower portion of the cab end structure;

a recess portion being open frontward, the recess portion being formed in a front portion of the end beam between the pair of post members; and an impact absorbing member formed on the front face of the end beam where a front end portion of the impact absorbing member projects from the end beam, wherein the recess portion has such a size that the impact absorbing member is accommodated within the recess portion after being compressively deformed.

2. The rolling stock according to claim 1, comprising:

lower reinforcement members provided between opposite side faces of a front end portion, on the end beam side, in a center beam of the underframe and lower end portions of the corresponding post members, respectively.

3. The rolling stock according to claim 2, comprising:

an upper reinforcement member provided on an upper face of the front end portion, on the end beam side, in the center beam of the under frame, the upper reinforcement member having a trapezoidal shape having a rear end portion corresponding to a width dimension of the center beam and a front end portion expanding toward both of the post members.

4. The rolling stock according to claim 1, comprising:

an upper reinforcement member provided on an upper face of the front end portion, on the end beam side, in the center beam of the under frame, the upper reinforcement member having a trapezoidal shape having a rear end portion corresponding to a width dimension of the center beam and a front end portion expanding toward both of the post members.

* * * * *